US005666732A

United States Patent [19]

Shea

[11] Patent Number: 5,666,732

[45] Date of Patent: Sep. 16, 1997

[54] HOLDER FOR USE WITH A RAZOR BLADE

[76] Inventor: Thomas M. Shea, 1407-C Allen Dr., Troy, Mich. 48083

[21] Appl. No.: 599,865

[22] Filed: Feb. 12, 1996

Related U.S. Application Data

[63] Continuation of Ser. No. 314,350, Sep. 28, 1994.

[51] Int. Cl.[6] ..... B26B 1/00

[52] U.S. Cl. ..... 30/329; 30/334; 30/169

[58] Field of Search ..... 30/329, 169, 335, 30/340, 342, 85, 86, 90, 337, 334; 15/236.01, 236.02, 236.03, 236.09

[56] References Cited

U.S. PATENT DOCUMENTS

| | | | |
|---|---|---|---|
| D. 243,638 | 3/1977 | Poisson . | |
| D. 245,460 | 8/1977 | Poisson . | |
| D. 255,160 | 5/1980 | Gray . | |
| D. 255,162 | 5/1980 | Trotta . | |
| D. 256,059 | 7/1980 | Poisson . | |
| D. 257,793 | 1/1981 | Gray . | |
| D. 258,270 | 2/1981 | Gray . | |
| D. 259,596 | 6/1981 | Gray . | |
| D. 260,944 | 9/1981 | Gray . | |
| D. 262,239 | 12/1981 | Gray . | |
| 2,119,045 | 5/1938 | Dietrich | 30/335 |
| 2,550,757 | 5/1951 | Bell | 30/335 |
| 2,773,663 | 12/1956 | Beers | 30/90 |
| 3,362,069 | 1/1968 | Blackwell | 30/329 |
| 3,430,339 | 3/1969 | Hobson | 30/329 |
| 3,587,171 | 6/1971 | Perry . | |
| 3,600,804 | 8/1971 | Brown . | |
| 3,723,195 | 3/1973 | Flaherty et al. . | |
| 3,829,969 | 8/1974 | Flachbein et al. . | |
| 3,835,537 | 9/1974 | Sastri . | |
| 3,855,700 | 12/1974 | Gerson et al. | 30/169 |
| 4,182,033 | 1/1980 | Jacobson et al. . | |
| 4,202,093 | 5/1980 | Wallerstein | 30/169 |
| 4,238,883 | 12/1980 | Jacobson et al. . | |
| 4,495,670 | 1/1985 | Baker | 30/169 |
| 4,612,707 | 9/1986 | Shea . | |
| 4,617,736 | 10/1986 | McCrary | 30/169 |
| 4,627,128 | 12/1986 | Shea . | |
| 4,705,320 | 11/1987 | Zamboni | 30/329 |
| 4,821,418 | 4/1989 | Windhager | 30/329 |
| 4,979,300 | 12/1990 | Blank et al. . | |
| 5,140,752 | 8/1992 | Kasprzak | 30/329 |

FOREIGN PATENT DOCUMENTS

| | | | |
|---|---|---|---|
| 0312554 | 5/1929 | United Kingdom | 30/329 |

*Primary Examiner*—Maurina T. Rachuba
*Attorney, Agent, or Firm*—Gifford, Krass, Groh, Sprinkle, Patmore, Anderson & Citkowski, P.C.

[57] ABSTRACT

A holder for use with a razor blade having a scraping edge and an opposite supporting edge. A body is constructed of a durable and flexible material and has a first face and a second face spaced a predetermined distance from the first face. A substantially straight edge and at least one additional edge connected to opposite sides of the straight edge defines an outline of the body. The straight edge includes an aperture which defines a cavity within the body for inserting the razor blade a predetermined distance. The cavity provides a friction fit between inwardly facing edges of the body and the razor blade upon insertion of the razor blade. A recess is formed along the straight edge of the first face and the second face for removing the blade from the holder and for rotating the blade from a working position to a storage position.

9 Claims, 1 Drawing Sheet

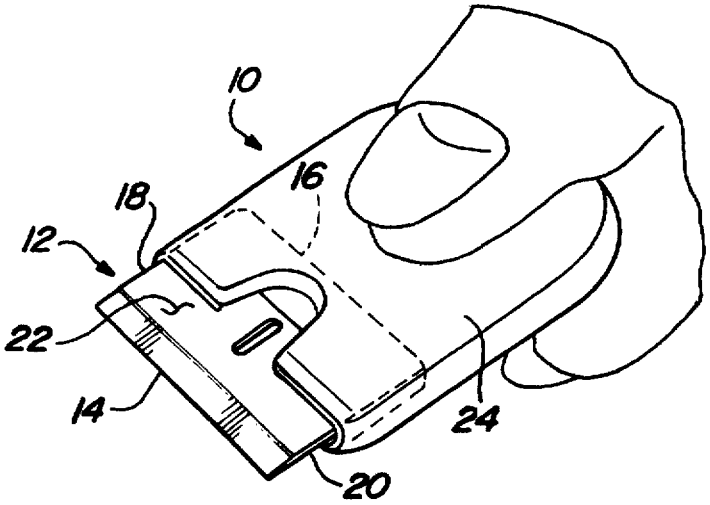
Fig - 1
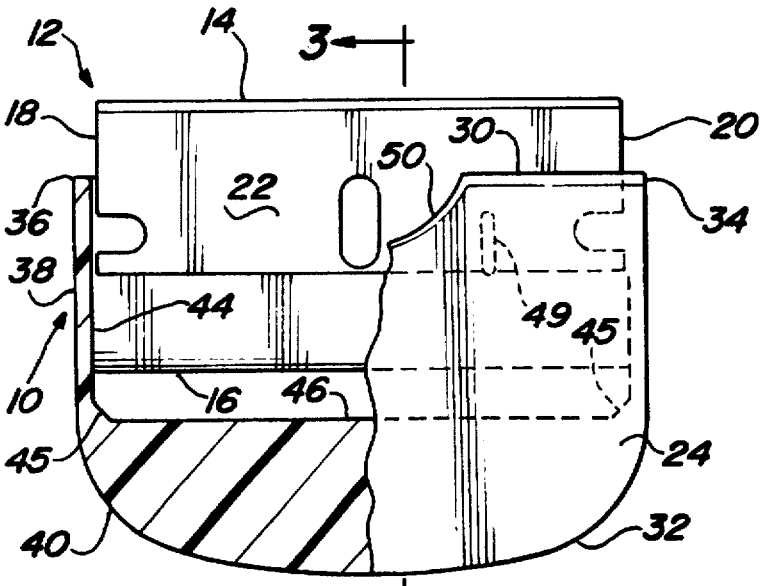
Fig - 2
Fig - 3
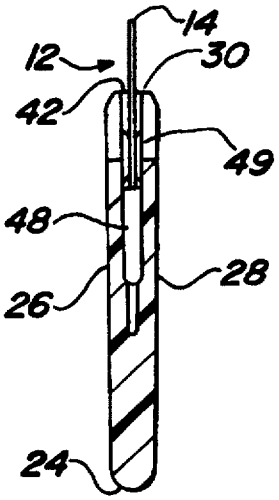
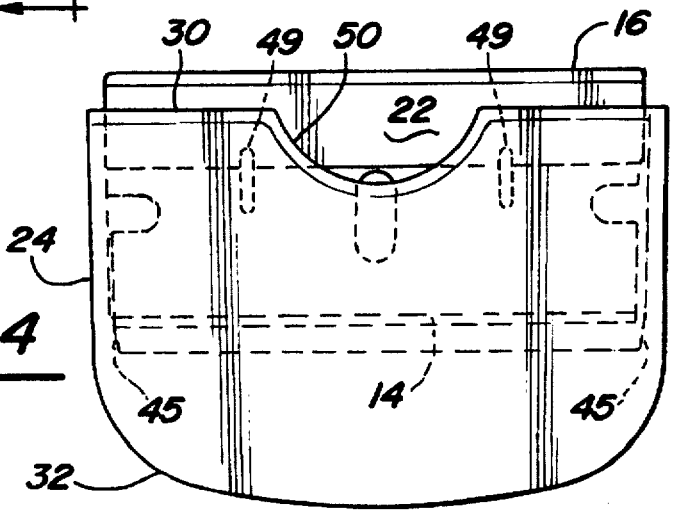
Fig - 4

HOLDER FOR USE WITH A RAZOR BLADE

This is a continuation of copending application Ser. No. 08/314,350 filed on Sep. 28, 1994.

BACKGROUND OF THE INVENTION

1. Field of the Invention

The present invention relates generally to razor blade holding devices and, more particularly, to a razor blade holder for use with a single edged razor blade which exerts a friction force along the edges of the razor blade to support the blade within the holder.

2. Description of the Prior Art

Razor blade holding devices are known in the art which permit a standard razor blade to be securely held and supported while the cutting or scraping edge of the blade engages a desired surface. Stanley Tool product No. 28-100, U.S. Pat. No. 4,979,300, for a mini-razor blade scraper teaches a holding device for securing the razor blade which allows the scraping edge of the blade to project outwardly. A pivoting tab portion is secured along an edge of the holder and is selectively opened and closed to lock the razor blade in place. The blade may further be rotated from a first position in which the cutting edge is revealed to a second position in which the cutting edge enclosed within the holder.

U.S. Pat. No. 4,612,707, issued to Shea, teaches a blade holding device in which a tab portion is located in the center of the blade holding body and is pivoted to engage an extending finger of the tab portion through a corresponding aperture of the razor blade to hold the blade in place.

The shortcoming of the prior art is that it does not teach a simplified razor blade holder which can quickly and easily exert a friction fit around the edges of a razor blade in order to hold the razor blade in place.

SUMMARY OF THE PRESENT INVENTION

A holder for use with a razor blade, the razor blade having a scraping edge and an opposite and supporting edge. The holder has a body with a first face and a second face spaced a predetermined distance from the first face. The body has a substantially straight edge and at least one additional edge connected to opposite sides of the straight edge to define an outline of the body.

The straight edge has an aperture formed therein which extends a distance between the first face and the second face to define a cavity within the body. The cavity corresponds substantially in shape to the outline of the razor blade and permits the razor blade to be inserted a predetermined distance within the body. The cavity provides a friction fit between inwardly facing edges of the body and the razor blade upon insertion of the razor blade. A recess is formed along the straight edge of the first face and the second face and reveals a portion of the razor blade which may be safely grasped by the user for removing the razor blade. The blade may therefore be rotated from a first working position displaying the scraping edge to a second storage position displaying the opposite and supporting edge.

BRIEF DESCRIPTION OF THE DRAWING

Reference will now be made to the attached drawing, when read in combination with the following specification, wherein like reference numerals refer to like parts throughout the several views, and in which:

FIG. 1 is a perspective view of the holder and razor blade according to the preferred embodiment;

FIG. 2 is a frontal view of the holder in partial cutaway and showing the cavity for supporting the razor blade;

FIG. 3 is a cutaway view taken along line 3—3 of FIG. 2 and showing the side of the holder and razor blade according to the present invention; and FIG. 4 is a view similar to that shown in FIG. 2 and showing the recess portion of the body and the outline of the cavity in phantom.

DESCRIPTION OF THE PREFERRED EMBODIMENT

Referring to FIGS. 1 and 2, a holder 10 for use with a razor blade 12 is shown. The razor blade 12 is of a conventional size and type and includes a first scraping edge 14, an opposite and supporting edge 16, a first side 18 and a second side 20 which separate the edges 14 and 16 and which form a pair of identical and opposing faces 22.

The holder 10 includes a body 24 which is constructed of a flexible and durable material and is preferably a polypropylene or a rubberized material. Referring further to FIG. 3, the body 24 has a first face 26 and a second face 28 spaced a predetermined distance from the first face 26. Referring again to FIG. 2, the outline of the body 24 is formed by a substantially straight edge 30 and an additional curved edge 32 which connects to the straight edge 30 at sides 34 and 36. The outline of the body 24 is such that it forms a first substantially rectangular portion 38 and a second curvilinear portion 40 extending from the rectangular portion. The outline of the body however can assume any other desirable shape so long as there is at least one substantially straight edge from which the cutting edge of the razor blade protrudes.

Referring again to FIG. 3, the straight edge 30 has an aperture 42 formed therein which extends between the first face 26 and the second face 28 of the body to define a cavity therein. Referring again to FIG. 2, the cavity corresponds substantially in shape to the outline of the razor blade and permits the razor blade to be inserted a predetermined distance within the body. Referring to the cutaway portion of FIG. 2, an inwardly facing edge 44 of the body biasingly engages against the side 18 of the razor blade 12 upon the razor blade being inserted a predetermined distance. The opposite side of the body not showing the cutaway has an identical inwardly facing edge which biasingly engages against the side 20 of the razor blade 12.

The inwardly facing edges of the body curve slightly at their bases, as seen from edges 45, to create a diagonally shaped corner and to increase the gripping force against the razor blade which permits the razor blade to travel an additional small distance towards a bottom edge 46 of the cavity. The diagonal shape of the corners 45 allows the corresponding corners of the blade to slightly embed within the material of the body and to enhance the frictional holding force against the blade. The razor blade 12 also preferably has a slightly enlarged portion 48 positioned towards its supporting edge 16 (see FIG. 3) which creates a biasing and friction fit contact against the inner sides of the faces 26 and 28 of the body which define the cavity. The friction fit of the razor blade within the cavity of the body prevents the razor blade from falling out of the body during use which could result in harm to the user.

Referring again to FIG. 3 and also to FIG. 4, two pairs of elongated protrusions 49 are formed onto the faces 26 and 28 of the body and extend in a direction of the cavity. The pairs of protrusions 49 are shown in phantom in FIG. 4 are spaced apart at opposite ends of the body. The pairs of protrusions provide additional frictional and holding contact of the razor blade to that provided by the edges and corners of the cavity.

Referring again to FIG. 4, the substantially straight edge 30 has a curved central portion 50 which defines a recess in the first face 26 and the second face 28 of the body. The recess reveals a portion of the opposite and identical faces 22 of the razor blade which protrude upwardly from within the cavity of the body. The curved central portion is preferably shown as a semicircle, however it can be of any other desired shape which will reveal a sufficient area of the razor blade surfaces.

Referring again to FIG. 2, the razor blade 12 is shown in a first use position in which the cutting edge 14 is exposed outwardly and the opposite and supporting edge 16 is opposite the bottom edge 46 of the body which defines the cavity.

The blade is gripped on its opposing sides 22 by the forefinger and thumb of the user and a predetermined pulling force is applied to the razor blade to disengage is from within the cavity. The razor blade may then be rotated from the use position shown in FIG. 2 to a second storage position shown in FIG. 4 in which the cutting edge 14 faces inwardly and the opposite and supporting edge 16 extends from the holder body. The blade may be quickly and easily rotated from the storage to the use positions as is desired.

Having described my invention, further embodiments will become apparent to those skilled in the art to which it pertains without deviating from the scope of the appended claims.

I claim:

1. A holder for use with a standard sized razor blade, the razor blade being substantially rectangular in shape and having a scraping edge, an opposite and supporting edge separated from the scraping edge by first and second sides and a series of corners connecting the scraping and supporting edges with the sides, said holder comprising:

a one-piece body having a first face, a second face spaced a predetermined distance from said first face, a substantially straight edge and at least one additional edge connected to opposite sides of said straight edge so as to define an outline of said body and to provide said body with a pair of opposite and inwardly facing edges, said straight edge having an aperture formed therein and extending between said first face and said second face a predetermined distance to define a cavity within said body;

said cavity closely conforming to the outline of the razor blade so as to permit the razor blade to be directly inserted a predetermined distance within said body;

a friction fit being created between said pair of opposite and inwardly facing edges of said body and the sides of the razor blade upon insertion of the razor blade;

said cavity terminating in a bottom edge which extends between said pair of opposite and inwardly facing edges, a first diagonally shaped corner connecting said bottom edge to a first of said inwardly facing edges and a second diagonally shaped corner connecting said bottom edge to a second of said inwardly facing edges, the corresponding corners of the razor blade frictionally embedding within said diagonally shaped corners upon insertion of the razor blade within said cavity; and a recess formed in said first face and said second face and extending from said straight edge in a direction toward said aperture;

whereby said recess permits the application of force to the razor blade to enable the razor blade to be frictionally disengage from within the body and to be rotated from a first working position displaying the scraping edge to a second storage position displaying the opposite and supporting edge.

2. The holder for use with a razor blade according to claim 1, said recess being semicircular in shape and revealing opposite faces of the razor blade which may be grasped with the fingers of the user.

3. The holder for use with a razor blade according to claim 1, said body overlaying said cavity having a first substantially rectangular portion, said body having a second curvilinear portion extending from said rectangular portion.

4. The holder for use with a razor blade according to claim 1, said body being constructed of a polypropylene.

5. The holder for use with a razor blade according to claim 1, said body being constructed of a rubberized material.

6. The holder for use with a razor blade according to claim 1, further comprising at least one pair of elongated protrusions placed upon at least one inner surface of said first face and said second face and extending in a direction into said cavity.

7. A holder for use with a standard sized razor blade, the razor blade being substantially rectangular in shape and having a first surface, a second surface, and a scraping edge, an opposite and supporting edge separated from the scraping edge by first and second sides and a series of corners connecting the scraping and supporting edges with the sides, said holder comprising:

a one-piece body having a first face, a second face spaced a predetermined distance from said first face, a substantially straight edge and at least one additional edge connected to opposite sides of said straight edge so as to define an outline of said body, said straight edge having an aperture formed therein and extending between said first face and said second face a predetermined distance to define a cavity within said body;

said cavity closely conforming to the outline of the razor blade to permit the razor blade to be directly inserted a predetermined distance within said body;

a friction fit being created between a pair of opposite and inwardly facing edges of said body and the sides of the razor blade upon insertion of the razor blade;

at least one pair of elongated protrusions placed upon at least one inner surface of said first face and said second face and extending in a direction into said cavity, said protrusions frictionally engaging the first and second surfaces of the razor blade upon insertion of the razor blade within said cavity; and a recess formed in said first face and said second face and extending in a direction extending toward said aperture;

whereby said recess permits the application of force to the razor blade to enable the razor blade to be frictionally disengaged from within the body and to be rotated from a first working position displaying the scraping edge to a second storage position displaying the opposite and supporting edge.

8. A combination holder and razor blade, comprising:

said razor blade being substantially rectangular in shape and having a scraping edge, an opposite and supporting edge separated from said scraping edge by first and second sides and a series of corners connecting said scraping and supporting edges with the sides, said holder comprising:

a one-piece body having a first face, a second face spaced a predetermined distance from said first face, a substantially straight edge and at least one additional edge connected to opposite sides of said straight edge so as to define an outline of said body and to provide said body with a pair of opposite and inwardly facing edges, said straight edge having an aperture formed therein and extending between said first face and said second face a predetermined distance to define a cavity within said body;

said cavity closely conforming to the outline of the razor blade so as to permit said razor blade to be directly inserted a predetermined distance within said body;

a friction fit being created between said pair of opposite and inwardly facing edges of said body and the sides of the razor blade upon insertion of said razor blade;

said cavity terminating in a bottom edge which extends between said pair of opposite and inwardly facing edges, a first diagonally shaped corner connecting said bottom edge to a first of said inwardly facing edges and a second diagonally shaped corner connecting said bottom edge to a second of said inwardly facing edges, the corresponding corners of said razor blade frictionally embedding within said diagonally shaped corners upon insertion of said razor blade within said cavity; and a recess formed in said first face and said second face and extending from said straight edge in a direction toward said aperture;

whereby said recess permits the application of force to said razor blade to enable said razor blade to be frictionally disengage from within the body and to be rotated from a first working position displaying the scraping edge to a second storage position displaying the opposite and supporting edge.

9. A combination holder and razor blade, comprising:

said razor blade being substantially rectangular in shape and having a first surface, a second surface, and a scraping edge, an opposite and supporting edge separated from said scraping edge by first and second sides and a series of corners connecting said scraping and supporting edges with the sides, said holder comprising:

a one-piece body having a first face, a second face spaced a predetermined distance from said first face, a substantially straight edge and at least one additional edge connected to opposite sides of said straight edge so as to define an outline of said body, said straight edge having an aperture formed therein and extending between said first face and said second face a predetermined distance to define a cavity within said body;

said cavity closely conforming to the outline of said razor blade to permit said razor blade to be directly inserted a predetermined distance within said body;

a friction fit being created between a pair of opposite and inwardly facing edges of said body and the sides of said razor blade upon insertion of said razor blade;

at least one pair of elongated protrusions placed upon at least one inner surface of said first face and said second face and extending in a direction into said cavity, said protrusions frictionally engaging the first and second surfaces of said razor blade upon insertion of said razor blade within said cavity; and a recess formed in said first face and said second face and extending in a direction extending toward said aperture;

whereby said recess permits the application of force to said razor blade to enable said razor blade to be frictionally disengaged from within the body and to be rotated from a first working position displaying the scraping edge to a second storage position displaying the opposite and supporting edge.

* * * * *